US009974990B1

(12) United States Patent
Bainton

(10) Patent No.: US 9,974,990 B1
(45) Date of Patent: May 22, 2018

(54) FIRE EXTINGUISHING AGENT DELIVERY APPARATUS, SYSTEM AND METHOD OF USE THEREOF

(71) Applicant: Andrew Bainton, Flushing, NY (US)

(72) Inventor: Andrew Bainton, Flushing, NY (US)

( * ) Notice: Subject to any disclaimer, the term of this patent is extended or adjusted under 35 U.S.C. 154(b) by 216 days.

(21) Appl. No.: 14/661,083

(22) Filed: Mar. 18, 2015

(51) Int. Cl.
*A62C 35/64* (2006.01)
*A62C 35/68* (2006.01)
*A62C 5/00* (2006.01)

(52) U.S. Cl.
CPC ..... *A62C 35/68* (2013.01); *A62C 5/002* (2013.01); *A62C 35/64* (2013.01)

(58) Field of Classification Search
CPC ..... A62C 5/002; A62C 35/68; A62C 35/64
USPC ..... 169/46, 14; 239/310
See application file for complete search history.

(56) References Cited

U.S. PATENT DOCUMENTS 1,758,812 A 5/1930 Williamson et al.
1,802,766 A 4/1931 Kerr
1,978,547 A 10/1934 McWane
2,414,260 A 1/1947 Hunter
2,636,519 A 4/1953 Bickham
2,707,480 A 5/1955 Klosse
2,741,467 A 4/1956 Lee et al.
2,811,211 A 10/1957 Eriksson
3,011,443 A * 12/1961 Nielsen ..... F04F 5/461 137/211
3,188,009 A 6/1965 Miscovich
3,234,962 A 2/1966 Williamson
3,338,173 A * 8/1967 Gunzel, Jr. ..... A01C 23/042 137/891
3,447,324 A 6/1969 French
3,671,025 A 6/1972 Elliott
4,993,495 A * 2/1991 Burchert ..... B01F 5/0403 169/14
5,063,787 A 11/1991 Khuzai et al.
5,085,278 A 2/1992 Keltner
5,091,118 A * 2/1992 Burgher ..... B01F 5/0451 261/123
5,113,945 A 5/1992 Cable
5,277,256 A 1/1994 Bailey
5,427,181 A 6/1995 Laskaris et al.
5,445,226 A 8/1995 Scott et al.
5,494,112 A 2/1996 Arvidson et al.
5,590,719 A 1/1997 McLoughlin et al.
5,909,775 A 6/1999 Grindley
(Continued)

*Primary Examiner* — Jason Boeckmann
(74) *Attorney, Agent, or Firm* — Galgano IP Law PLLC; Thomas M. Galgano; Jessica G. McDonald

(57) ABSTRACT

A fire extinguishing agent delivery apparatus, system, and method of use having an outer tube with an inlet attached to a pressurized water source and an outlet attached to a firefighting hose. The apparatus includes an inner venturi tube mounted within the outer tube, having a funnel-shaped inlet and outlet, a reduced diameter intermediate portion, and an extinguishing agent inlet port. The apparatus includes a device for injecting extinguishing agent into the inlet port and the venturi tube has a smaller diameter than the outer tube, so a portion of water travels through the venturi tube and mixes with extinguishing agent and a greater portion of water travels unobstructed through the outer tube and mixes with the mixture of water and fire extinguishing agent discharged from the venturi tube, prior to discharge from the outer tube.

21 Claims, 4 Drawing Sheets

(56) References Cited

U.S. PATENT DOCUMENTS

| | | | |
|---|---|---|---|
| 5,992,529 | A | 11/1999 | Williams |
| 6,039,065 | A | 3/2000 | Gagliardo |
| 6,113,004 | A | 9/2000 | Steingass et al. |
| 6,386,293 | B1 | 5/2002 | Bartlett |
| 7,942,139 | B1 | 5/2011 | Rockwell |
| 2007/0002679 | A1 | 1/2007 | Sharma et al. |
| 2009/0178812 | A1 | 7/2009 | Solomon et al. |

* cited by examiner

FIRE EXTINGUISHING AGENT DELIVERY APPARATUS, SYSTEM AND METHOD OF USE THEREOF

BACKGROUND OF THE INVENTION

1. Field of the Invention

The invention is generally in the field of firefighting equipment. More particularly, the present invention relates to a device for attachment to a pressurized water source to mix and deliver a pressurized mixture of water and fire extinguishing agent to a fire hose, to more effectively extinguish fires.

2. Brief Description of the Prior Art

Firefighting in high-rise and fireproof buildings presents unique challenges both logistically, with getting firefighting personnel and firefighting equipment to the fire as well as tactically, in delivering an adequate volume of water into the fire hose lines which are utilized to attack and extinguish the fire.

These problems are further compounded by the increase in fire loading found in modern day buildings and structures. The fire loading of a building is a means of establishing the potential severity of a hypothetical future fire and is utilized in evaluating industrial safety risks. Fire loading is measured by the heat output per unit floor area, often in $kJ/m^2$, which is calculated from the calorific value of the materials present. The increased fire loading found in modern day buildings is due, in part, to the increased use of petroleum based products in manufacturing building materials such as, for example, the furnishings, wall and floor coverings, and various other everyday items. As a result of these factors, today's fires burn hotter than in the past and reach flash over (i.e., the near-simultaneous ignition of the most directly exposed combustible material in an enclosed area) more quickly. Another difficulty in fighting fires in such buildings is the buildings' retention of heat from the fire, and the difficulty of the building being able to manually vent the heat from the fire floor or floors. Windblown fires add yet another dimension to these firefighting problems.

To more effectively combat fires, many municipalities and fire codes have required the installation of standpipe systems into buildings to facilitate firefighting efforts in certain classes of buildings where certain of the above described problems are present. In North America, a standpipe is a type of rigid water piping which is typically built into multi-story buildings in a vertical position or bridges in a horizontal position, to which fire hoses can be connected, allowing manual application of water to the fire.

Typically, the standpipe extends into the building to supply firefighting water to the interior of the structure via hose outlets, often located between each floor in stairwells in high-rise buildings. Firefighters often bring hoses in with them and attach them to standpipe outlets located along the pipe throughout the structure. For example, a conventional standpipe system provide a 2.5" inch hose connection for use primarily by trained personnel or by the fire department during initial response. The fire department will typically carry hose packs to the floor level, typically a stairwell, where they will start their operations by connecting the fire hoses to the standpipe system.

While the standpipe systems are utilized to better deliver water to fight the fires, the cooling power of the water is limited by the size of the hose lines used, and the amount of water that can be delivered to the fire through the hose line. A conventional fire hose is a high-pressure hose that carries water, or other fire retardant, to a fire to extinguish it. Outdoors, the fire hose attaches either to a fire engine or a fire hydrant. Indoors, the hose can attach to the building's standpipe or plumbing system. Currently, a conventional fire hose is approximately 2.5" in diameter, and delivers water at the rate of approximately 200-250 gallons per minute (GPM). The normal working pressure of a fire hose can vary between 8 to 20 bar (800 to 2,000 kPa; 116 to 290 psi).

Furthermore, modern day fire extinguishing agents also known as "wetting agents", such as those designated by the National Fire Protection Association (NFPA) and UL, have been developed which, when mixed with water, allow for increased absorption of heat per gallon, as compared to water alone. Particularly, modern day wetting agents are utilized in structural fires by extinguishing a fire by rapidly cooling the fire to the point where vapors are not given off or are reduced to a point where the amount of vapor is too minimal to support combustion. As a result, these fire extinguishing agents increase the cooling effect of the water through the mixture of water and fire extinguishing agent absorbing proportionally more heat per gallon of water as compared to water alone or even as compared to conventional fire-fighting foams such as, aqueous film forming foams (AFFF) or Fluroprotein foams, lending to their use in structural fires. As a results, systems have been developed which allow for the incorporation of fire extinguishing agents into a hose stream, however the presently known devices have certain limitations which do not allow them to be used in effectively fighting the types of fires mentioned above.

Particularly, many known devices are used to produce firefighting foams, which typically require much lower flow rates and pressures than those of the present invention. Typically, traditional firefighting foams, such as AFFF and Fluoroprotein, are utilized to create a foam blanket which smothers the fire. However, the cooling that takes place as a result of the foam, is limited to the natural properties of the water and are ineffective in structural fires. Furthermore, an important feature of these foam generating devices is to operate at low flow rates, so as to not disturb the foam blanket as it is being formed. When the foam blanket is disturbed, air is reintroduced into the burning substance, mainly flammable liquids, and vapors can escape and be re-ignited. In addition, disadvantageously, many foam delivery systems require multiple nozzles which must be exchanged when delivering water or treated water.

For example, U.S. Pat. No. 5,445,226 sets forth a "Foam Generating Nozzle" which uses air to agitate the water/concentrate mixture to create foam. However, the nozzle has a limited reach of the distance it can throw the mixture, which is significantly less than the reach of a regular fire nozzle. Furthermore, the nozzle set forth in this patent, is a low flow device which operates at pressures lower than in the present invention and in a conventional standpipe system. Thus, the nozzle in the '226 patent would have to be exchanged for a different nozzle in order to deliver an appropriate volume of untreated water at an appropriate pressure for the size hose line in use with conventional standpipe systems U.S. Pat. No. 4,993,495 is also a low flow and low pressure device and requires the use of two separate nozzles in order to deliver water and foam, one of which is specialized foam generating nozzle. U.S. Pat. No. 6,386,293 B1 is also a low flow and low pressure device and does not function at conventional operating pressures or flow rates of a conventional standpipe system.

Therefore, while there are many known devices and equipment to aid in the extinguishing of fires, they are unsatisfactory for use with modern fire extinguishing agents and are unsatisfactory in fighting fires found in modern day buildings, and in high-rise buildings in particular which utilize higher pressure and flow rate standpipe systems.

SUMMARY OF THE INVENTION

Accordingly, it is an object of the present invention to provide a novel fire extinguishing agent delivery apparatus, system, and method of use thereof, for the mixing and delivery of a fire extinguishing agent with pressurized water.

It is a further object of the present invention to provide a fire extinguishing agent delivery apparatus, system, and method of use thereof that can be attached to a building's standpipe system or permanently incorporated into the standpipe system.

It is another object of the present invention to provide a novel fire extinguishing agent delivering apparatus, system, and method of use thereof that delivers the mixture of fire extinguishing agent and water at normal operating pressures and flow rates of a conventional standpipe system, preferably at approximately 200-250 GPM.

It is yet another object of the present invention to provide a portable fire extinguishing agent delivery apparatus, system, and method of use thereof.

Additionally, it is an object of the present invention to provide a fire extinguishing agent delivery apparatus, system, and method of use thereof which does not require specialized equipment downstream of the mixing point.

Certain of the foregoing and related objects are readily attained according the present invention through the provision of a fire extinguishing agent delivery apparatus, for attachment between a water source and an inlet of a firefighting hose, comprising a generally cylindrical outer tube comprising a first open end defining an inlet, a second open end opposite therefrom defining an outlet, and a fluid channel extending through said outer tube which establishes fluid communication between said inlet and said outlet thereof, and wherein said inlet of said outer tube is configured and dimensioned to attach to the water source, to receive pressurized water therefrom and said outlet of said outer tube is configured and dimensioned to attach to the inlet of the firefighting hose, to deliver a pressurized mixture of water and fire extinguishing agent thereto; a generally cylindrical inner venturi tube mounted within said outer tube, said inner venturi tube having a first open end defining an inlet to receive pressurized water from said fluid channel of said outer tube, a second open end opposite therefrom defining an outlet, to deliver a pressurized mixture of water and fire extinguishing agent to said fluid channel of said outer tube, and a fluid channel extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion, and said inner venturi tube is configured and dimensioned to define a reduced pressure zone in said fluid channel of said inner venturi tube, between said inlet and said outlet thereof; an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube; and wherein said inner venturi tube has an outer diameter which is smaller than the inner diameter of said outer tube, such that a portion of the fluid channel of said outer tube is unobstructed by said inner venturi tube to permit a first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube.

Preferably, said outer tube comprises an inner wall and said inner venturi tube is mounted generally adjacent to said inner wall of said outer cylindrical tube. In a preferred embodiment, said means for injecting fire extinguishing agent into said extinguishing agent inlet port comprises an electric pump which pumps fire extinguishing agent into said reduced pressure zone of said fluid channel of said inner venturi tube.

Alternatively, said means for injecting fire extinguishing agent into said extinguishing agent inlet port comprises pneumatic means to inject fire extinguishing agent into said reduced pressure zone of said fluid channel of said inner venturi tube. Desirably, said inner venturi tube has a length of approximately five inches and an outer diameter of approximately one inch. It is also preferred that said outer tube has a diameter of approximately 2.5". In the presently preferred embodiment, the amount of water that travels through said inner venturi tube is approximately 16% and the amount of water that travels unobstructed through said outer tube is approximately 84%.

Desirably, the apparatus further comprises means for metering the concentration of fire extinguishing agent injected into said extinguishing agent inlet port. Advantageously, the apparatus further comprises a check valve disposed upstream of said extinguishing agent inlet port. Additionally, the apparatus further comprises a hollow screw having a fluid channel defined therein and wherein said inner venturi tube is mounted to said outer tube with said hollow screw, to permit fire extinguishing agent to travel through said fluid channel of said screw and into said extinguishing agent inlet port.

In the preferred embodiment, said second open end of said inner venturi tube is spaced inwardly from said second open end of said outer tube, to permit pressurized water traveling unobstructed through said outer tube to mix with said pressured mixture of water and fire extinguishing agent discharged from said outlet of said inner venturi tube into said fluid channel of said outer tube, before being discharged from said outlet of said outer cylindrical tube. Preferably the water source delivers pressurized water into said inlet of said outer tube at a rate of approximately 200 to 250 gallons per minute and said pressurized mixture of water and fire extinguishing agent discharged from said outlet of said outer tube into the firefighting hose is at a rate of approximately 200 to 250 gallons per minute.

Certain of the foregoing and related objects are also readily attained according to the present invention through the provision of a firefighting assembly for delivering a pressurized mixture of water and fire extinguishing agent to a firefighting hose, comprising a pressurized water source having an outlet; a fire extinguishing agent delivery apparatus for attachment between said pressurized water source and an inlet of the firefighting hose, comprising a generally cylindrical outer tube comprising a first open end defining an inlet, a second open end opposite therefrom defining an outlet, and a fluid channel extending through said outer tube which establishes fluid communication between said inlet and said outlet thereof, and wherein said inlet of said outer tube is connected to said pressurized water source, to receive pressurized water therefrom and said outlet of said outer tube is configured and dimensioned to attach to the inlet of the firefighting hose, to deliver a pressurized mixture of water and fire extinguishing agent thereto; a generally cylindrical inner venturi tube mounted within said outer tube, said inner venturi tube having a first open end defining an inlet to receive pressurized water from said fluid channel of said outer tube, a second open end opposite therefrom defining an outlet to deliver a pressurized mixture of water and fire extinguishing agent to said fluid channel of said outer tube, and a fluid channel extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion and said inner venturi tube is configured and dimensioned to define a reduced pressure zone in said fluid channel of said inner venturi tube, between said inlet and said outlet thereof; an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube; and wherein said inner venturi tube has an outer diameter which is smaller than the inner diameter of said outer tube, such that a portion of the fluid channel of said outer tube is unobstructed by said inner venturi tube to permit a first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube.

In the preferred embodiment, the apparatus further comprises a firefighting hose attached to and in fluid communication with said outlet of said outer tube. Preferably, said pressurized water source is a standpipe. Desirably, the apparatus further comprises a source of fire extinguishing agent in fluid communication with said extinguishing agent inlet port, for injections into said extinguishing agent inlet port via said means for injecting fire extinguishing agent.

In the presently preferred embodiment, said pressurized water source delivers pressurized water into said inlet of said outer tube at a rate of approximately 200 to 250 gallons per minute and said pressurized mixture of water and fire extinguishing agent discharged from said outlet of said outer tube into the firefighting hose is at a rate of approximately 200 to 250 gallons per minute.

Furthermore, certain of the foregoing and related objects are readily attained according to the present invention through the provision of a method for extinguishing a fire, comprising the steps of providing a pressurized water source and a firefighting hose having an inlet; providing a fire extinguishing agent delivery apparatus connectable to said pressurized water source and said firefighting hose, comprising a generally cylindrical outer tube comprising a first open end defining an inlet, a second open end opposite therefrom defining an outlet, and a fluid channel extending through said outer tube which establishes fluid communication between said inlet and said outlet thereof, and wherein said inlet of said outer tube is configured and dimensioned to attach to said pressurized water source, to receive pressurized water therefrom and said outlet of said outer tube is configured and dimensioned to attach to said inlet of said firefighting hose, to deliver a pressurized mixture of water and fire extinguishing agent thereto; a generally cylindrical inner venturi tube mounted within said outer tube, said inner venturi tube having a first open end defining an inlet to receive pressurized water from said fluid channel of said outer tube, a second open end opposite therefrom defining an outlet to deliver a pressurized mixture of water and fire extinguishing agent to said fluid channel of said outer tube, and a fluid channel extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion, and said inner venturi tube is configured and dimensioned to define a reduced pressure zone in said fluid channel of said inner venturi tube, between said inlet and said outlet thereof; an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube; and wherein said inner venturi tube has an outer diameter which is smaller than the inner diameter of said outer tube, such that a portion of the fluid channel of said outer tube is unobstructed by said inner venturi tube to permit a first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube; providing a source of fire extinguishing agent in fluid communication with said extinguishing agent inlet port, for injection into said extinguishing agent inlet port via said means for injecting fire extinguishing agent; connecting said inlet of said outer tube to said pressurized water source; connecting said outlet of said outer tube to said inlet of said firefighting hose; injecting fire extinguishing agent under pressure into said extinguishing agent inlet port of said inner venturi tube via said means for injecting, to mix with said first portion of water traveling through said fluid channel of said inner venturi tube and be discharged from said outlet of said inner venturi tube into said fluid channel of said outer tube, to mix with said greater second portion of water traveling unobstructed through said fluid channel of said outer tube; and discharging said pressurized mixture of water and fire extinguishing agent from said outlet of said outer tube into said inlet of said firefighting hose for discharge therefrom.

Preferably, said pressurized water source delivers pressurized water into said inlet of said outer tube at a rate of approximately 200 to 250 gallons per minute; and said pressurized mixture of water and fire extinguishing agent discharged from said outlet of said outer tube into said firefighting hose is at a rate of approximately 200 to 250 gallons per minute. Advantageously, a pressure of said fire extinguishing agent injected into said inlet port of said inner venturi tube is greater than the pressure in said reduced pressure zone of said inner venturi tube.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
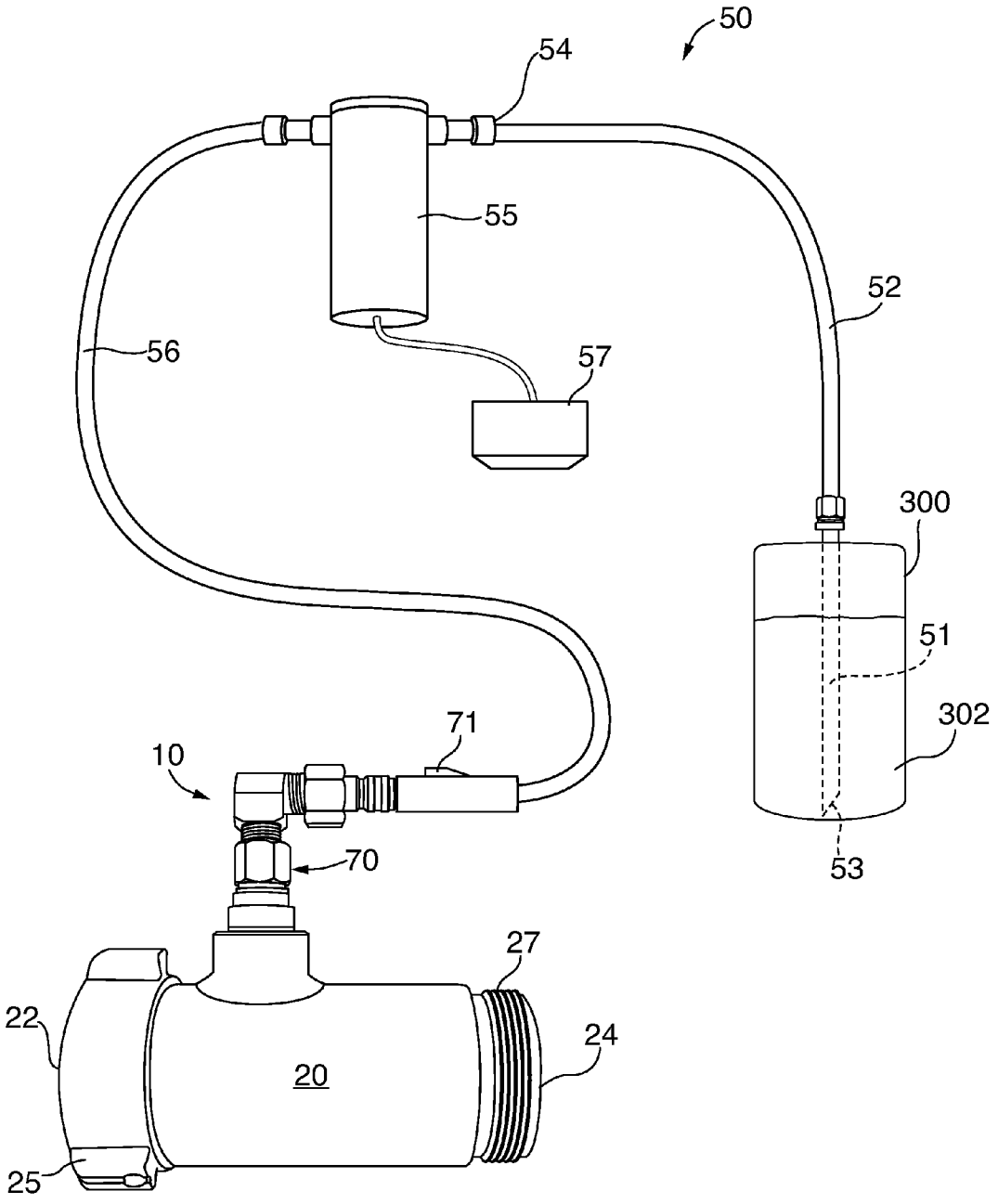
FIG. 1 is a perspective view of a first embodiment of the fire extinguishing agent delivery apparatus and system, according to the present invention, utilizing an electric pump.

Turning now in detail to the present invention and, in particular, FIG. 1 which illustrates the fire extinguishing agent delivery and mixing apparatus, generally designated by reference numeral 10. As seen best in FIG. 5, apparatus 10 can be connected to the outlet 102 of a standpipe connection 100. Apparatus 10 is utilized to mix and deliver a pressurized mixture of water and fire extinguishing agent to an attached fire hose 200, at the normal operating pressures and flow rates expected in a given length of attack hose line 200, to more effectively extinguish fires. Particularly, the apparatus 10, according to the present invention, delivers the pressurized mixture of water and fire extinguishing agent to hose 200 at the same flow rates and pressures as the water entering apparatus 10 from the pressurized water source, here standpipe connection 100, and preferably at a flow rate of approximately 200-250 GPM. However, the apparatus 10 can be utilized to accommodate a flow rate of 0-1,000 GPM and pressure of 0-250 psi and can be modified in size to accommodate different flow rates and pressures and to fit different sized hose lines.

Figure 5:
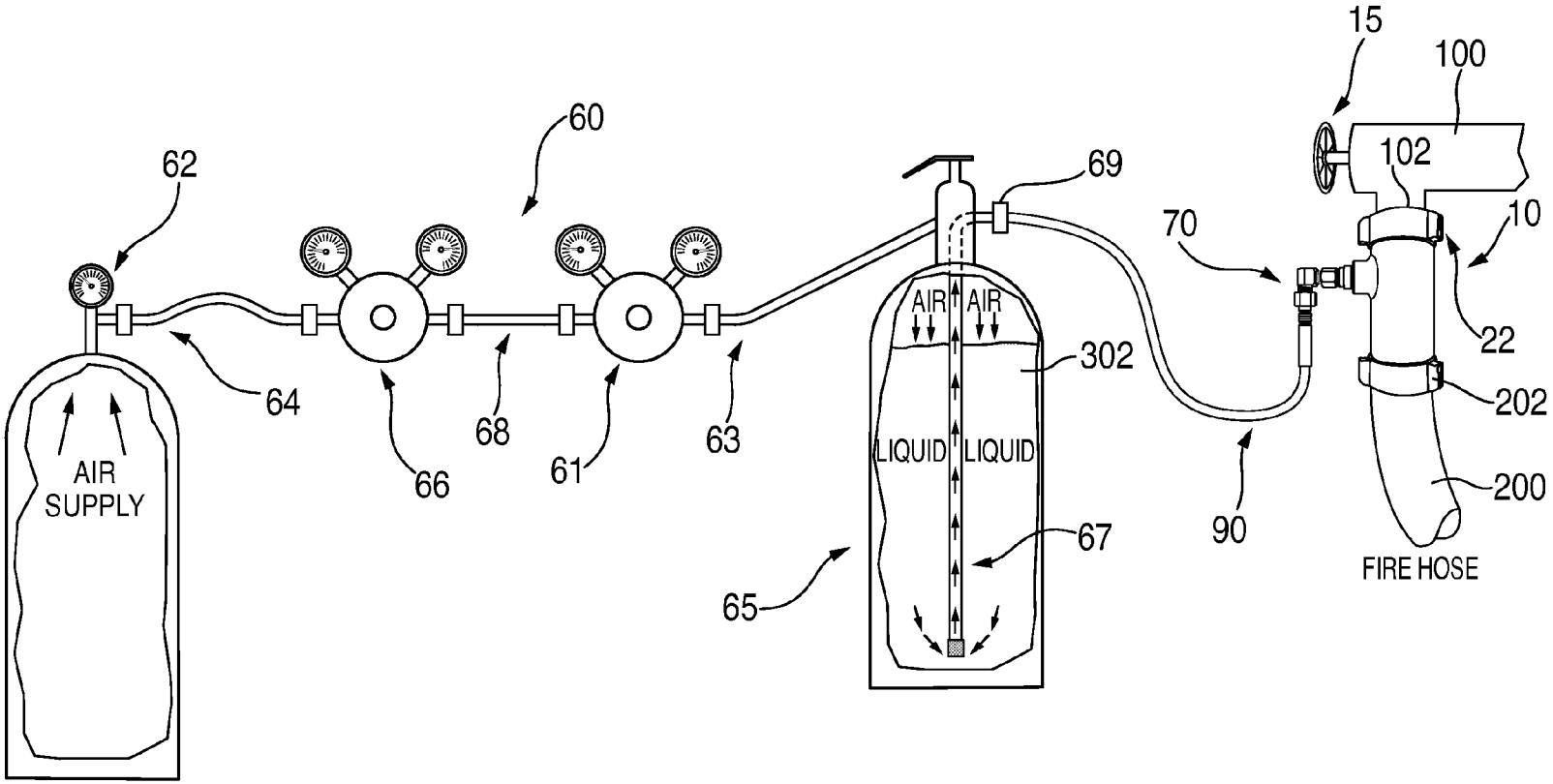
FIG. 5 is a perspective view of a second embodiment of the system according to the present invention, utilizing pneumatic means for injecting the extinguishing agents, shown connected in between a standpipe and a fire hose.

Particularly, as seen in FIGS. 1 and 5, the fire extinguishing agent delivery and mixing apparatus 10, is attached on its first end 22, serving as its inlet, to a pressurized water source, here a standpipe system 100 having an outlet connection 102. The second, opposite end 24 of apparatus 10, serving as its outlet, is connected to an inlet 202 of a firefighting attack hose 200. Conventional standpipe connections 100 and conventional firefighting hoses 200 typically have standard threaded connections, which allow for their mating connection. Particularly, standpipe connection 100 has an outlet 102 having an approximately 2.5" externally threaded connection. The first end 22 of outer cylindrical tube 20 has an approximately 2.5" female internally threaded swivel connection which mates with the corresponding threaded outlet connection 102 on standpipe 100. Here, end 22 has the same 2.5" internally threaded swivel connection 25 as on a conventional fire hose 200, and end 24 has the same 2.5" externally threaded connection 27 as on a conventional standpipe outlet 102.

However, it can be appreciated that the size of apparatus 10 can be modified to accommodate different sized hose lines and water sources, such as for use with 1.5" or 1.75" hose lines or hose lines having a diameter greater than 2.5". Furthermore, apparatus 10 can be used with adaptors (not shown) which allow the apparatus 10 to connect to hose lines and water sources having a larger or a smaller diameter than that of ends 22 or 24 of apparatus 10.

The apparatus 10 can be permanently attached or otherwise permanently incorporated into the standpipe system 100 or it can be a portable device that is attached to the standpipe 100, when needed. While the apparatus 10 is shown attached to a standpipe connection 100, the present invention can be utilized with other pressurized water sources, such as, those on ship board fires or bridges (not shown). Furthermore, the apparatus 10 can be attached to a pumper outlet (not shown) such as on a fire hydrant, or to a fire engine, pumper truck, or combination ladder and pumper truck, or at any location along the stretch of the firefighting hose line. Additionally, apparatus 10 can be utilized in other applications to mix two fluids. For example, apparatus 10 can be utilized in farming to mix liquid fertilizers or insecticides into a hose line to deliver the resulting mixture to plants. The benefit of apparatus 10 is that it allows for longer stretches of hose lines to be utilized and allows for injection of the fire extinguishing agent closer to the fire. This eliminates the drawbacks of the prior art systems which are inefficient at delivering water at adequate pressures.

As also seen in FIGS. 1-4, the fire extinguishing agent delivery and mixing apparatus 10 includes a generally cylindrical outer tube 20 having first open end 22 defining the inlet and an opposite second open end 24 opposite therefrom defining the outlet. In the preferred embodiment, the outer tube 20 is approximately 7.75" in length and has an approximately 2.5" inner diameter. Inlet 22 of the outer tube 20 is configured and dimensioned to connect to a source of pressurized water, such as the standpipe 100, illustrated in FIG. 5, in order to receive pressurized water therefrom. In use, end 22 is connected to standpipe 100 by engaging the swivel connection 25 with the corresponding externally threaded connection on the outlet 102 of standpipe 100. In the preferred embodiment, the standpipe 100 provides pressurized water to the apparatus 10 at 200-250 GPM.

The second open end 24 of the outer cylindrical tube 20 is configured and dimensioned to attach to the inlet 202 of the firefighting hose 200, to deliver a pressurized mixture of water and fire extinguishing agent to the firefighting hose 200, preferably at the same pressure and flow rate as the pressurized water entering the apparatus 10 from standpipe 100, and preferably at, 200-250 GPM. Particularly, end 24 has external threads 27 which correspond and engage with the internally threaded female swivel connection 202 on fire hose 200. Furthermore, as seen best in FIG. 3, outer cylindrical tube 20 has a fluid channel 26 extending therethrough which establishes fluid communication between inlet 22 and outlet 24 and, when attached to water source 100, and fire hose 200 is in fluid communication therewith.

The desired flow rates and pressurizations of the pressured water entering apparatus 10, and water the and fire extinguishing agent mixture exiting apparatus 10, can vary depending on the application. However, in all applications, the pressurized mixture of water and extinguishing agent discharged from apparatus 10 into hose 200 is at essentially the same flow rates and pressurizations of the water entering the apparatus 10, from the pressurized water source 100. Thus, the pressure exiting the apparatus 10 into the fire-fighting hose 200 are at the normal operating pressures and flow rates expected in a given length of hose 200 connected to a standpipe, namely, 200-250 GPM, in the preferred embodiment. Accordingly, there is no decrease in the flow rates and pressurizations of the water exiting the apparatus 10, which allows it to more effectively extinguish fires.

Figure 3:
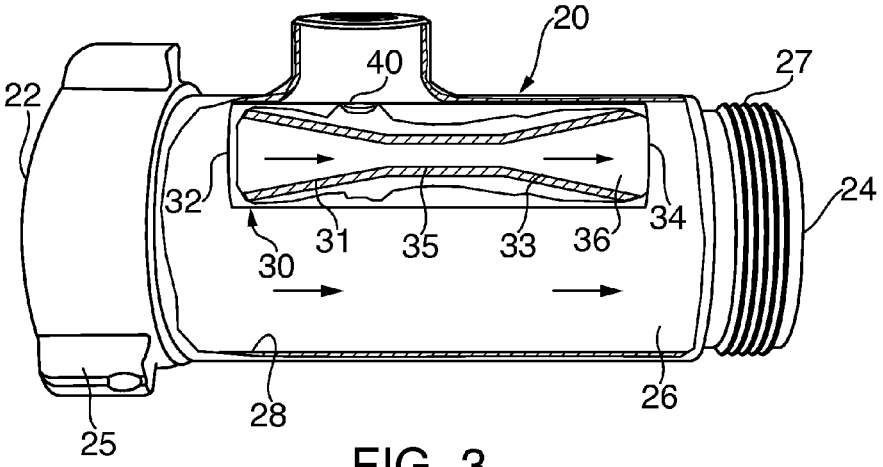
FIG. 3 is a side elevational view of the fire extinguishing agent delivery apparatus with the outer cylindrical tube and inner venturi tube, illustrated partially in section.

As seen best in FIG. 3, a generally cylindrical inner venturi tube 30 is mounted within outer cylindrical tube 20. In the preferred embodiment, inner venturi tube 30 is approximately 5" in length. As seen best in FIG. 4, the outer cylindrical tube has an inner wall 28 and the inner venturi tube 30 is mounted generally adjacent to the inner wall 28 of outer cylindrical tube 20. Inner venturi tube 30 has a first open end 32 defining an inlet, which is spaced inwardly from the inlet 22 of outer cylindrical tube 20, in order to receive pressurized water from fluid channel 26 of outer cylindrical tube 20. Inner venturi tube 30 also has a second open end 34 opposite from inlet 32, defining an outlet, which is spaced inwardly from the outlet 24 of the outer cylindrical tube 20, in order to deliver a pressurized mixture of water and fire extinguishing agent to the fluid channel 26 of outer tube 20, prior to discharge from apparatus 10. In the preferred embodiment, inlet 32 of inner venturi tube 30 is spaced inwardly approximately 1⅝" from inlet 22 of outer cylindrical tube 20 and outlet 34 of inner venturi tube 30 is spaced inwardly approximately 1⅛" from outlet 24 of outer cylindrical tube 20. As seen in FIG. 3, inner venturi tube 30 also includes a fluid channel 36 extending therethrough which is in fluid communication with fluid channel 26 of outer tube 20.

As shown best in FIG. 3, inner venturi tube 30 has an inwardly tapered funnel-shaped inlet portion 31 adjacent to inlet 32 and an inwardly tapered funnel-shaped outlet portion 33 adjacent to outlet 34. Fluid channel 36 of inner venturi tube 30 has an intermediate portion 35 between inlet portion 31 and outlet portion 33 which has a reduced diameter as compared to inlet 32 and outlet 34. The intermediate portion 35 preferably has a diameter of 3/16" and a length of 1¼" and is spaced 1⅞" inwardly from inlet 32 and outlet 34. In the preferred embodiment, inlet 32 and outlet 34 of inner venturi tube 30 have a diameter of approximately 1 inch and the funnel-shaped inlet portion 31 and outlet portion 33 taper down from 1 inch to approximately 3/16" inch and are 1⅞" in length. Additionally, in the preferred embodiment, the inner walls of the funnel-shaped inlet portion 31 and funnel-shaped outlet portion 33 are angled approximately 15° from the center line of the inner venturi tube 30.

As a result of the reduced diameter intermediate portion 35, a reduced pressure zone is formed in fluid channel 36 of inner venturi tube 30. In the fluid channel 36 of inner venturi tube 30, the pressure is reduced as a result of the venturi effect caused by the venturi tube 30. Particularly, as a result of the venturi effect, the water traveling through the funnel-shaped portion 31 and intermediate reduced diameter 35 portion increases in velocity which, in turn, decreases the pressure in the fluid channel 36 of the inner venturi tube 30. The reduction in pressure in the reduced pressure zone of fluid channel 36 facilitates injection of fire extinguishing agent into the fluid channel 36 of inner venturi tube 30. Particularly, the reduced pressure zone allows for injection of the fire extinguishing agent concentrates at a greater pressure than that created in the fluid channel 36 of inner venturi tube 30. Preferably, the pressure within the reduced pressure zone of fluid channel 36 is at least 10 psi less than the pressure of the extinguishing agent injected into the fluid channel 36.

The apparatus 10 also includes an extinguishing agent inlet port 40 disposed adjacent and upstream to the reduced diameter intermediate portion of inner venturi tube 30, to deliver fire extinguishing agent into the reduced pressure zone of fluid channel 36. Particularly, the reduced pressure zone of fluid channel 36 is downstream of the extinguishing agent inlet port 40. Extinguish agent injected into inlet port 40 mixes with water traveling through fluid channel 36 and is subsequently discharged via outlet 34 of inner venturi tube 30, to mix with water traveling through fluid channel 26 of outer cylindrical tube 20, prior to discharge from outlet 24. In the preferred embodiment, inlet port 40 is a channel formed in inner venturi tube 30. Preferably, inlet port 40 has a diameter of ⅜". In contrast to other fire extinguishing apparatus, the reduced pressure zone is not utilized to draw in the fire extinguishing agent, but rather is utilized to create a low pressure zone which facilitates injection of the fire extinguishing agent into inner venturi tube 30, via inlet port 40. In operation, the pressure within reduced pressure zone is less than the pressure at which the extinguishing agent is injected at inlet port 40. Preferably, the pressure in reduced pressure zone 35 is at least 10 psi less than the pressure at which the extinguishing agent is injected into inlet port 40.

Optionally, apparatus 10 includes a pressure gauge and/or flow meter gauge (not shown). In the preferred embodiment, the pressure gauge and/or flow meter gauge are located downstream of the outlet 34 of inner venturi tube 30. In the embodiments incorporating the pressure gauge and flow meter gauge, the length of outer cylindrical tube 20 can be increased to accommodate for the pressure gauge and flow meter gauge.

Apparatus 10 also includes means for injecting fire extinguishing agent under pressure into the extinguishing agent inlet port 40, in order to mix the fire extinguishing agent with the pressurized water traveling through the fluid channel 36 of inner venturi tube 30. Inlet port 40 permits the extinguishing agent to be injected at the point of operation directly into the stream of water. An advantage of the present apparatus is that the extinguishing agent is mixed outside of the fire pump and at the point of operation, which eliminates the need to flush the fire pump, saving both time and water.

In a first preferred embodiment, shown in FIG. 1, the means for injecting the fire extinguishing agent into inlet port 40 is an electric pump system 50. Preferably, the electric pump system 50 injects the extinguishing agent at a pressure of 0-150 psi. Particularly, as seen in FIG. 1, the electric pump system 50 includes an intake hose line 52 connected to an intake tube 51. Intake tube 51 has an open end 53 which is inserted into a container or reservoir 300 containing fire extinguishing agent concentrate 302, in order to draw the liquid concentrate 302 therefrom. The second end 54 of hose 52 is connected to an electrically powered pump 55 which is utilized to pump the fire extinguishing agent concentrate 302 through the intake tube 51 and into intake hose line 52 and exit the pump 55 into a concentrate discharge hose line 56 which is connected to and in fluid communication with inlet port 40 of apparatus 10. As seen in FIG. 1, pump 55 can be powered by a battery 57 connected thereto. Optionally, battery 57 includes an on/off switch, and battery charge indicator (not shown).

Figure 2:
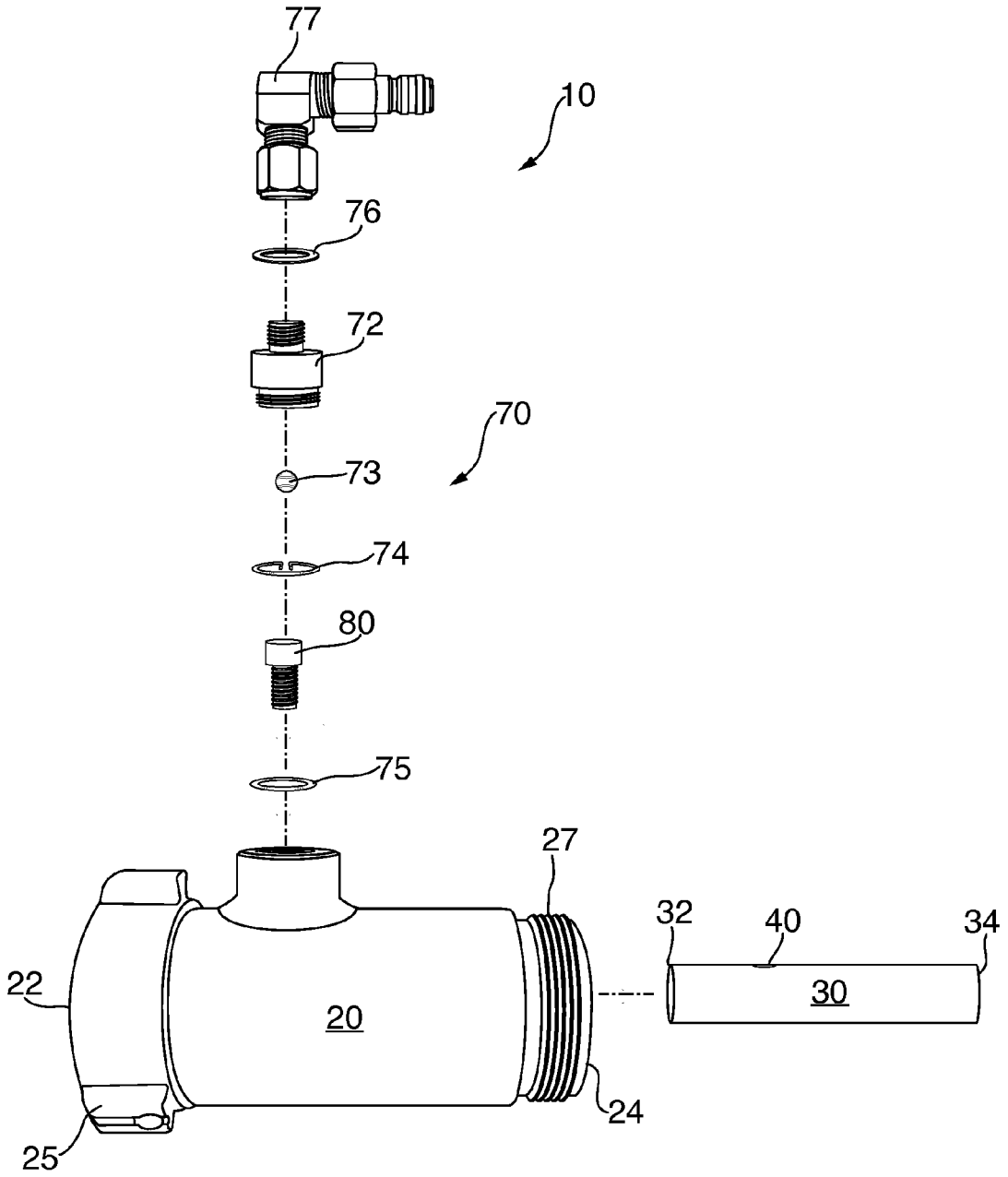
FIG. 2 is an exploded view of the fire extinguishing agent delivery apparatus, according to the present invention.

As seen best in FIG. 2, the connection between hose line 56 and apparatus 10 includes a metering device 70 connected upstream of inlet port 40. In the presently preferred embodiment, the metering device 70 includes a one-way check valve 72 which allows the concentration of fire extinguishing agent injected into inlet port 40 to be varied. The diameter of the opening formed in metering device 70 allows for the adjustment of the concentrates injected into inlet port 40. In a preferred embodiment, check valve 72 includes a ball 73 held by a retaining clip 74. However, it can be appreciated that other metering devices can be utilized with the present invention, such as a conventional and adjustable dial metering device. Furthermore, the preferred embodiment includes washers 75 and 76. Preferably, the concentrate discharge hose 56 also includes a shut off valve 71 to stop the flow of concentrate into inlet port 40.

Particularly, in a preferred embodiment, the means for injecting the fire extinguishing agent, inject the fire extinguishing agent concentrate into apparatus 10 at 0.5 GPM and a concentration of 0-10%. The flow rate of the pressurized water flowing through apparatus 10 is preferably at 250 GPM into a 2.5" fire hose. Therefore, the concentration of fire extinguishing agent to water exiting outlet 24 of apparatus 10 is 0.2%. However, the flow rate and concentration of fire extinguishing agent to water depends on the size of metering device 70 and the preferred concentrations of fire extinguishing agent to water depend on the particular agent utilized.

In a second preferred embodiment, as shown in FIG. 5, the means for injecting the fire extinguishing agent into the inlet port 40 is a pneumatic system 60. Particularly, in a preferred embodiment of the present invention, the pneumatic injection system 60, as seen in FIG. 5, includes a pressurized air supply source 62 having an air-supply shut-off means to turn the flow of air on and off. It is preferable that the air pressure within the pressurized air supply source is within the range of 3000-4500 psi. In the preferred embodiment, a minimum of 6 cubic feet of air is required. For example, suitable air supply sources are any which supply an adequate air pressure such as, an air compressor, scuba bottles, or other self-contained breathing bottles. Air supply source 62 is connected via a high pressure air hose 64 to one end of a first stage pressure regulator 66, which is utilized to reduce the pressure of the air flowing from the air supply source 62. In the preferred embodiment, first stage pressure regulator 66 reduces the pressure from approximately 3000-4500 psi to approximately 300 psi.

The opposite end of the first stage pressure regulator 66 is connected to a first stage air manifold 68, which is connected on one end to a second stage, pressure regulator 61, which is utilized to further reduce the pressure. Preferably, the second stage pressure regulator 61 reduces the pressure from approximately 300 psi to a working pressure of approximately 10-20 psi greater than the pressure in the reduced pressure zone of fluid channel 36. The air then travels through a second stage air supply hose 63 which is connected to a pressurized liquid supply tank 65. Liquid supply tank 65 contains the fire extinguishing agent liquid concentrate 302 for injection into apparatus 10. For example, suitable fire extinguishing agent concentrates are any liquid Class A, Class B or Wetting Agent as designated by NFPA and/or UL. However, the present invention is not limited thereto and any fire extinguishing agent concentrate in liquid form may be utilized in conjunction with the present invention.

In particular, liquid supply tank 65 contains a liquid discharge riser 67 and a control valve/shut-off mechanism. The pressurized air forces the fire extinguishing agent concentrate 302 to rise through the liquid discharge riser 67 to exit the outlet 69 of the liquid supply tank 65 and into a discharge hose 90 which is connected to the inlet port 40 of the apparatus 10. Preferably, the fire extinguishing agent concentrate 302 is injected into the inlet port at a pressure of 0-300 psi.

The present pneumatic system is shown for the purpose of illustration only and other pneumatic systems are possible. For example, the pressure regulators may be automatic and no gauges are necessary. Thus, it can be appreciated that other pneumatic means may be utilized to inject the fire extinguishing agent liquid concentrate into the inlet port and such pneumatic means would be well known to those having ordinary skill in the art.

Figure 4:
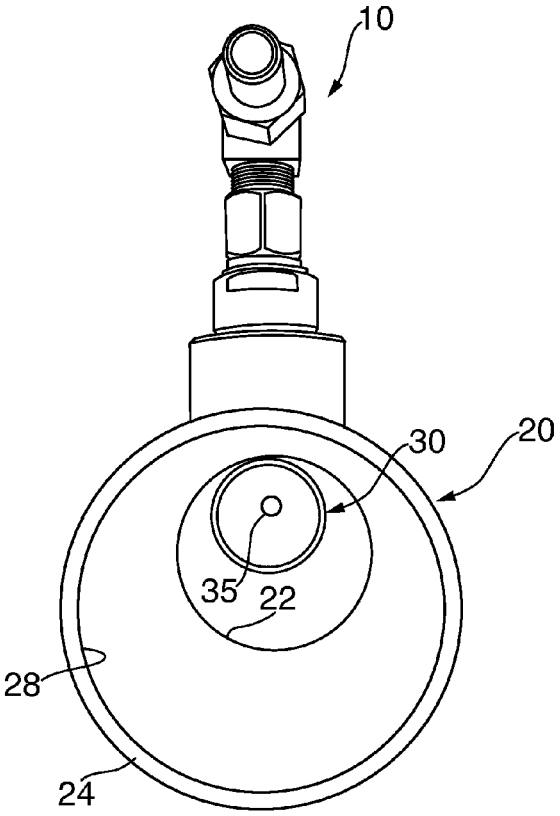
FIG. 4 is a rear and bottom perspective view of the fire extinguishing agent delivery apparatus.

As seen best in FIGS. 3 and 4, inner venturi tube 30 has an outer diameter which is smaller than the diameter of inner wall 28 of outer cylindrical tube 20 and inner venturi tube 30 is disposed adjacent to inner wall 28 of outer cylindrical tube 20. Preferably, the inner venturi tube has a length of approximately six inches, an outer diameter of approximately one inch, and includes a ⅜" diameter longitudinal inner channel defined therein. Accordingly, a lesser amount of water travels through inner venturi tube 30 in comparison to outer cylindrical tube 20. In the preferred embodiment, approximately 16% of the water travels through the inner venturi tube 30 and approximately 84% of the water travels unobstructed through the fluid channel 26 of the outer cylindrical tube 20. While the exact percentages of water traveling through tubes 20 and 30 may vary, a majority of water flows unobstructed through outer cylindrical tube 20 so that the pressurized mixture of water and fire extinguishing agent discharged from apparatus 10 is at the same flow rates and pressures as that entering apparatus 10.

As shown in FIG. 2, the inner venturi tube 30 is mounted to outer cylindrical tube 20 via a hollow screw 80 having a central hollow fluid channel defined therein, to permit the fire extinguishing agent to travel therethrough into inlet port 40. As seen best in FIG. 4, a portion of fluid channel 26 of outer tube 20 is unobstructed by inner venturi tube 30. Therefore, a portion of water travels through fluid channel 36 of inner venturi tube 30 and mixes with the fire extinguishing agent injected via inlet port 40. Additionally, a second portion of water travels unobstructed through fluid channel 26 of outer cylindrical tube 20 at the same flow rates and pressures as the water entering inlet 22 from the pressurized water source. The water traveling through fluid channel 26 mixes with the mixture of water and fire extinguishing agent discharged from the outlet 34 of inner venturi tube 30, prior to discharge from outlet 24 of outer tube 20. This pressurized mixture of water and fire extinguishing agent is then delivered into fire hose 200, to more effectively extinguish fires.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention. Particularly, while the preferred embodiments have been described in connection with a 2.5" hose line and water pressures of 200-250 gallons per minute, it can be appreciated that the present invention can be modified proportionally to increase or decrease its size to accommodate larger or smaller diameter hoses and varying flow rates and pressures.

What is claimed is:

1. A fire extinguishing agent delivery apparatus, for attachment between a water source and an inlet of a firefighting hose, comprising:

a generally cylindrical outer tube comprising a first open end defining an inlet, a second open end opposite therefrom defining an outlet, and a cylindrical inner surface having a uniform inner diameter defining a fluid channel therebetween having a diameter, said fluid channel extending through said outer tube which establishes fluid communication between said inlet and said outlet thereof, and wherein said inlet of said outer tube is configured and dimensioned to attach to the water source, to receive pressurized water therefrom and said outlet of said outer tube is configured and dimensioned to attach to the inlet of the firefighting hose, to deliver a pressurized mixture of water and fire extinguishing agent thereto;

an inner venturi tube having a cylindrical outer surface along its entire length and circumference, said cylindrical outer surface of said inner venturi tube having a uniform diameter, said inner venturi tube being mounted within said fluid channel of said outer tube, such that said cylindrical outer surface of said inner venturi tube abuts said inner surface of said outer tube; said inner venturi tube having a first open end defining an inlet located within said fluid channel of said outer tube, to receive pressurized water from said fluid channel of said outer tube, a second open end opposite therefrom defining an outlet which is located within said fluid channel of said outer tube and is spaced inwardly from said second open end of said outer tube, to deliver a pressurized mixture of water and fire extinguishing agent to a downstream portion of said fluid channel of said outer tube defined between said second open end of said inner tube and said outlet of said outer tube, said downstream portion of said fluid channel of said outer tube having a uniform diameter, and an inner surface defining a fluid channel therebetween extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion between said inlet portion and said outlet portion, and said inner venturi tube is configured and dimensioned to define a reduced pressure zone in said fluid channel of said inner venturi tube, between said inlet and said outlet thereof;

an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube;

and wherein said diameter of said outer surface of said inner venturi tube is smaller than said diameter of said inner surface of said outer tube, such that a majority of the fluid channel of said outer tube is unobstructed by said inner venturi tube to permit a lesser first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube, such that the flow rate and pressure of the pressurized water delivered into said inlet of said outer tube is substantially the same as the flow rate and pressure of said pressured mixture of water and fire extinguishing agent discharged from said outlet of said outer tube.

2. The apparatus according to claim 1, wherein:

said means for injecting fire extinguishing agent into said extinguishing agent inlet port comprises an electric pump which pumps fire extinguishing agent into said reduced pressure zone of said fluid channel of said inner venturi tube.

3. The apparatus according to claim 1, wherein:

said means for injecting fire extinguishing agent into said extinguishing agent inlet port comprises pneumatic means to inject fire extinguishing agent into said reduced pressure zone of said fluid channel of said inner venturi tube.

4. The apparatus according to claim 1, wherein:

said inner venturi tube has a length of approximately five inches and an outer diameter of approximately one inch.

5. The apparatus according to claim 1, wherein:

said outer tube has a diameter of approximately 2.5".

6. The apparatus according to claim 1, wherein:

the amount of water that travels through said inner venturi tube is approximately 16% and the amount of water that travels unobstructed through said outer tube is approximately 84%.

7. The apparatus according to claim 1, further comprising:

means for metering the concentration of fire extinguishing agent injected into said extinguishing agent inlet port.

8. The apparatus according to claim 1, further comprising:

a check valve disposed upstream of said extinguishing agent inlet port.

9. The apparatus according to claim 1, further comprising:

a hollow screw having a fluid channel defined therein and wherein said inner venturi tube is mounted to said outer tube with said hollow screw, to permit fire extinguishing agent to travel through said fluid channel of said screw and into said extinguishing agent inlet port.

10. The apparatus according to claim 1, wherein:

the water source delivers pressurized water into said inlet of said outer tube at a rate of approximately 200 to 250 gallons per minute and said pressurized mixture of water and fire extinguishing agent discharged from said outlet of said outer tube into the firefighting hose is at a rate of approximately 200 to 250 gallons per minute.

11. The apparatus according to claim 1, wherein:

said inner diameter of said inner surface of said outer tube is the same as the diameter of said fluid channel of said outer tube immediately downstream of said second open end of said inner venturi tube.

12. A firefighting assembly for delivering a pressurized mixture of water and fire extinguishing agent to a firefighting hose, comprising:

a pressurized water source having an outlet; and a fire extinguishing agent delivery apparatus for attachment between said pressurized water source and an inlet of the firefighting hose, comprising a generally cylindrical outer tube comprising a first open end defining an inlet, a second open end opposite therefrom defining an outlet, and a cylindrical inner surface having a uniform inner diameter defining a fluid channel therebetween having a diameter, said fluid channel extending through said outer tube which establishes fluid communication between said inlet and said outlet thereof, and wherein said inlet of said outer tube is connected to said pressurized water source, to receive pressurized water therefrom and said outlet of said outer tube is configured and dimensioned to attach to the inlet of the firefighting hose, to deliver a pressurized mixture of water and fire extinguishing agent thereto; an inner venturi tube having a cylindrical outer surface along its entire length and circumference, said cylindrical outer surface of said inner venturi tube having a uniform diameter, said inner venturi tube being mounted within said fluid channel of said outer tube, such that said cylindrical outer surface of said inner venturi tube abuts said inner surface of said outer tube; said inner venturi tube having a first open end defining an inlet located within said fluid channel of said outer tube, to receive pressurized water from said fluid channel of said outer tube, a second open end opposite therefrom defining an outlet which is located within said fluid channel of said outer tube and is spaced inwardly from said second open end of said outer tube, to deliver a pressurized mixture of water and fire extinguishing agent to a downstream portion of said fluid channel of said outer tube defined between said second open end of said inner tube and said outlet of said outer tube, said downstream portion of said fluid channel of said outer tube having a uniform diameter, and an inner surface defining a fluid channel therebetween extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion between said inlet portion and said outlet portion, and said inner venturi tube is configured and dimensioned to define a reduced pressure zone in said fluid channel of said inner venturi tube, between said inlet and said outlet thereof; an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube; and wherein said diameter of said outer surface of said inner venturi tube is smaller than said diameter of said inner surface of said outer tube, such that a majority of the fluid channel of said outer tube is unobstructed by said inner venturi tube to permit a lesser first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube, such that the flow rate and pressure of the pressurized water delivered into said inlet of said outer tube is substantially the same as the flow rate and pressure of said pressurized mixture of water and fire extinguishing agent discharged from said outlet of said outer tube.

13. The assembly according to claim 12, further comprising:

a firefighting hose attached to and in fluid communication with said outlet of said outer tube.

14. The assembly according to claim 12, wherein:

said pressurized water source is a standpipe.

15. The assembly according to claim 12, further comprising:

a source of fire extinguishing agent in fluid communication with said extinguishing agent inlet port, for injections into said extinguishing agent inlet port via said means for injecting fire extinguishing agent.

16. The assembly according to claim 12, wherein:

said pressurized water source delivers pressurized water into said inlet of said outer tube at a rate of approximately 200 to 250 gallons per minute and said pressurized mixture of water and fire extinguishing agent discharged from said outlet of said outer tube into the firefighting hose is at a rate of approximately 200 to 250 gallons per minute.

17. The assembly according to claim 12, wherein:

said inner diameter of said inner surface of said outer tube is the same as the diameter of said fluid channel of said outer tube immediately downstream of said second open end of said inner venturi tube.

18. A method for extinguishing a fire, comprising the steps of:

providing a pressurized water source and a firefighting hose having an inlet;

providing a fire extinguishing agent delivery apparatus connectable to said pressurized water source and said firefighting hose, comprising a generally cylindrical outer tube comprising a first open end defining an inlet, a second open end opposite therefrom defining an outlet, and a cylindrical inner surface having a uniform inner diameter defining a fluid channel therebetween having a diameter, said fluid channel extending through said outer tube which establishes fluid communication between said inlet and said outlet thereof, and wherein said inlet of said outer tube is configured and dimensioned to attach to said pressurized water source, to receive pressurized water therefrom and said outlet of said outer tube is configured and dimensioned to attach to said inlet of said firefighting hose, to deliver a pressurized mixture of water and fire extinguishing agent thereto; an inner venturi tube having a cylindrical outer surface along its entire length and circumference, said cylindrical outer surface of said inner venturi tube having a uniform diameter, said inner venturi tube being mounted within said fluid channel of said outer tube, such that said cylindrical outer surface of said inner venturi tube abuts said inner surface of said outer tube; said inner venturi tube having a first open end defining an inlet located within said fluid channel of said outer tube, to receive pressurized water from said fluid channel of said outer tube, a second open end opposite therefrom defining an outlet which is located within said fluid channel of said outer tube and is spaced inwardly from said second open end of said outer tube, to deliver a pressurized mixture of water and fire extinguishing agent to a downstream portion of said fluid channel of said outer tube defined between said second open end of said inner tube and said outlet of said outer tube, said downstream portion of said fluid channel of said outer tube having a uniform diameter, and an inner surface defining a fluid channel therebetween extending through said inner venturi tube which establishes fluid communication between said inlet and said outlet thereof and is in fluid communication with said fluid channel of said outer tube, and wherein said inner venturi tube has a funnel-shaped inlet portion adjacent to said inlet thereof, a funnel-shaped outlet portion adjacent to said outlet thereof, and a reduced diameter intermediate portion between said inlet portion and said outlet portion, and said inner venturi tube is configured and dimensioned to define a reduced pressure zone in said fluid channel of said inner venturi tube, between said inlet and said outlet thereof; an extinguishing agent inlet port disposed in said inner venturi tube, to deliver fire extinguishing agent to said reduced pressure zone of said fluid channel of said inner venturi tube, for discharge via said outlet of said inner venturi tube; and means for injecting fire extinguishing agent under pressure into said extinguishing agent inlet port, to mix the fire extinguishing agent with pressurized water traveling through said fluid channel of said inner venturi tube; and wherein said diameter of said outer surface of said inner venturi tube is smaller than said diameter of said inner surface of said outer tube, such that a portion of the fluid channel of said outer tube is unobstructed by said inner venturi tube to permit a first portion of water to travel through said fluid channel of said inner venturi tube and mix with the fire extinguishing agent and a greater second portion of water to travel unobstructed through said fluid channel of said outer tube and to mix with said mixture of water and fire extinguishing agent discharged from said outlet of said inner venturi tube, prior to discharge from said outlet of said outer tube, such that the flow rate and pressure of the pressurized water delivered into said inlet of said outer tube is substantially the same as the flow rate and pressure of said pressured mixture of water and fire extinguishing agent discharged from said outlet of said outer tube;

providing a source of fire extinguishing agent in fluid communication with said extinguishing agent inlet port, for injection into said extinguishing agent inlet port via said means for injecting fire extinguishing agent;

connecting said inlet of said outer tube to said pressurized water source;

connecting said outlet of said outer tube to said inlet of said firefighting hose;

injecting fire extinguishing agent under pressure into said extinguishing agent inlet port of said inner venturi tube via said means for injecting, to mix with said first portion of water traveling through said fluid channel of said inner venturi tube and be discharged from said outlet of said inner venturi tube into said fluid channel of said outer tube, to mix with said greater second portion of water traveling unobstructed through said fluid channel of said outer tube; and discharging said pressurized mixture of water and fire extinguishing agent from said outlet of said outer tube into said inlet of said firefighting hose for discharge therefrom.

19. The method according to claim 15, wherein:

said pressurized water source delivers pressurized water into said inlet of said outer tube at a rate of approximately 200 to 250 gallons per minute; and said pressurized mixture of water and fire extinguishing agent discharged from said outlet of said outer tube into said firefighting hose is at a rate of approximately 200 to 250 gallons per minute.

20. The method according to claim 15, wherein:

a pressure of said fire extinguishing agent injected into said inlet port of said inner venturi tube is greater than the pressure in said reduced pressure zone of said inner venturi tube.

21. The method according to claim 19, wherein:

said inner diameter of said inner surface of said outer tube is the same as the diameter of said fluid channel of said outer tube immediately downstream of said second open end of said inner venturi tube.

* * * * *